US006202240B1

(12) United States Patent
Tsung-Ping

(10) Patent No.: US 6,202,240 B1
(45) Date of Patent: Mar. 20, 2001

(54) SHOE INSERT

(76) Inventor: Chen Tsung-Ping, No. 41, Lane 65, Alley 200, Section 4, Kuang Fu Road, Feng Tien Village, Tien Wei Hsiang, Chang Hua Hsien (TW)

( * ) Notice: Subject to any disclaimer, the term of this patent is extended or adjusted under 35 U.S.C. 154(b) by 0 days.

(21) Appl. No.: 09/370,917

(22) Filed: Aug. 9, 1999

(51) Int. Cl.[7] ..... A43D 3/00

(52) U.S. Cl. ..... 12/128 R; 12/141; 12/114.6; 12/114.2; 12/128 B

(58) Field of Search ..... 12/128 R, 141, 12/128 B, 114.6, 114.2, 128 C, 128 H, 133 R; D2/979

(56) References Cited

U.S. PATENT DOCUMENTS 620,835 * 3/1899 Bemis .
896,536 * 8/1908 Hayden ..... 12/128 B
2,262,622 * 11/1941 Reinhardt ..... 12/128 R
2,361,531 * 10/1944 Clausing .
3,175,237 * 3/1965 Bass ..... 12/116.8
5,446,936 * 9/1995 Barger ..... 12/128 R
5,639,295 * 6/1997 Wellinghoff et al. ..... 106/15.05

FOREIGN PATENT DOCUMENTS

229762 * 2/1963 (AT) ..... 12/128 R
1151268 * 1/1958 (FR) ..... 12/128 R
611773 * 10/1960 (IT) ..... 12/128 R

* cited by examiner

*Primary Examiner*—M. D. Patterson
(74) *Attorney, Agent, or Firm*—Harrison & Egbert

(57) ABSTRACT

A shoe insert having a body formed of a recycled waste paper material. The body has a hollow interior which opens at a bottom of said body. The body has a seat formed at a rear end thereof. The seat has a through hole formed in a top planar surface of said seat. The through hole has a diameter suitable for allowing a human finger to pass thereinto.

2 Claims, 4 Drawing Sheets

SHOE INSERT

FIELD OF THE INVENTION

The present invention relates generally to a shoe insert, and more particularly to an insert that is used inside a shoe to support the surface of the shoe in a straight and upright manner.

BACKGROUND OF THE INVENTION

A shoe insert is usually inserted so as to reside at the front tip of the shoe to support upwardly inner portion of the shoe. This causes the shoe's surface to be straight and upright. The shoe insert is which is a very important part to use inside the shoe. This will cause manufacturers to give more efforts in improving the shoe lining whether on the shapes or on the materials.

Nowadays, various shapes and materials of the shoe lining can be found on the market. Among those materials are plastics, bubbles, and papers. However, the structure of them can be divided into a paper ball-shape and a plastic or bubble plate-shape. Such structure is defective in design as described hereinafter.

1. The paper ball-shape of the shoe lining is taken from a waste paper. This structure does not adequately support the shoe material in an upright manner.
2. The plastic plate-shape of the shoe lining is tough and not biodegradable, but it can not be decomposed naturally and that will cause an environmental problem.
3. The bubble plate-shape of the shoe lining is light, but it also cannot adequately support the material of the shoe and does not remove the environmental problem.

SUMMARY OF THE INVENTION

The primary objective of the present invention to provide a shoe insert which is free from the shortcomings of the conventional shoe insert described above.

The structure of the present invention shoe insert is of a hollow construction at the bottom. This will correspond to the area on the inner sole of the shoe. The shoe insert is formed with a seat which is provided with a through hole on a top surface thereof. Such design of the present invention is cost-effective because it is made from high fiber content recycled paper.

The features, functions, and advantages of the present invention will be readily understood upon a thoughtful deliberation of the following detailed description of the embodiments of the present invention with reference to the accompanying drawings.

DETAILED DESCRIPTION OF THE INVENTION

Figure 1:
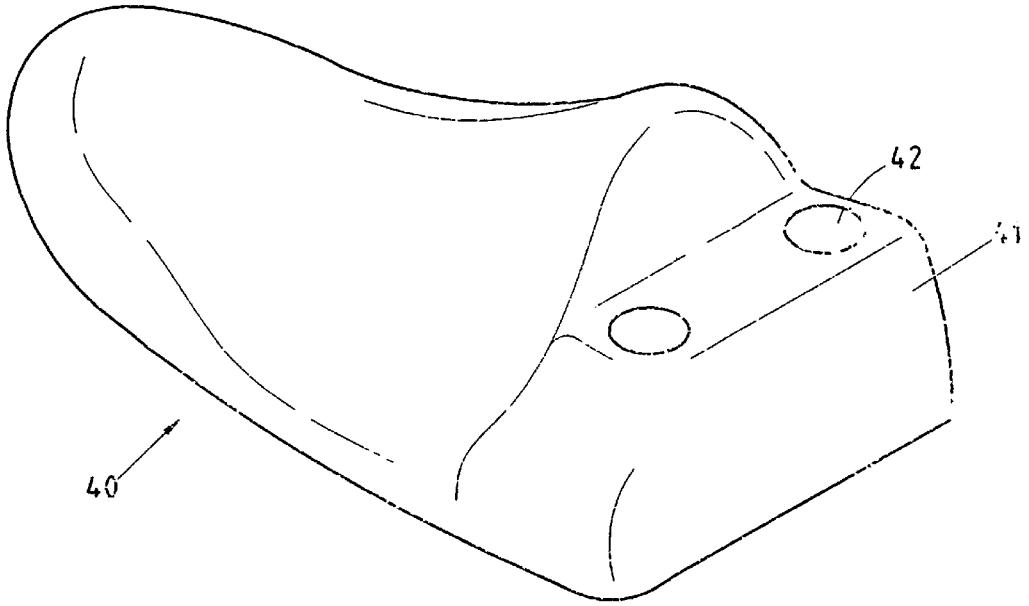
FIG. 1 shows a perspective view of the present invention.
Figure 2:
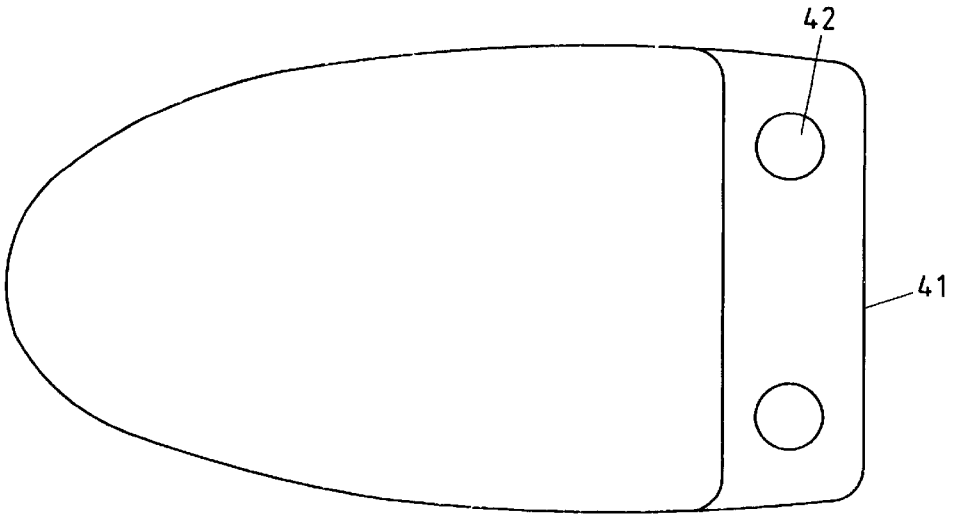
FIG. 2 shows a schematic plan view from the top portion of the present invention.
Figure 3:
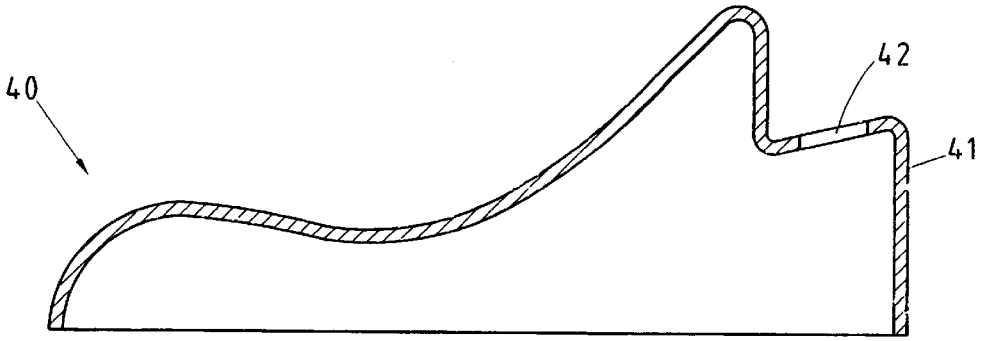
FIG. 3 shows a sectional view of the present invention.

As shown in FIGS. 1–3, a shoe insert 40 is of hollow construction at the bottom end thereof in which its shape corresponds to the shape of the toe portion inside the shoe. A seat 41 is formed at a rear end of the shoe insert 40 and is provided with a through hole 42 of a proper size so as to facilitate the ability to grasp it with a finger.

Figure 4:
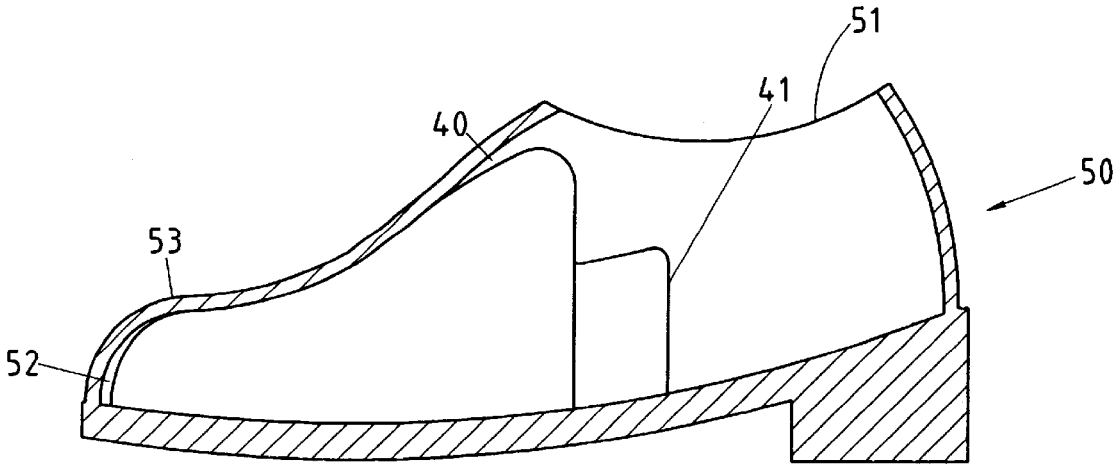
FIG. 4 shows a sectional view of the present invention in retaining at the inner portion of the shoe.
Figure 5:
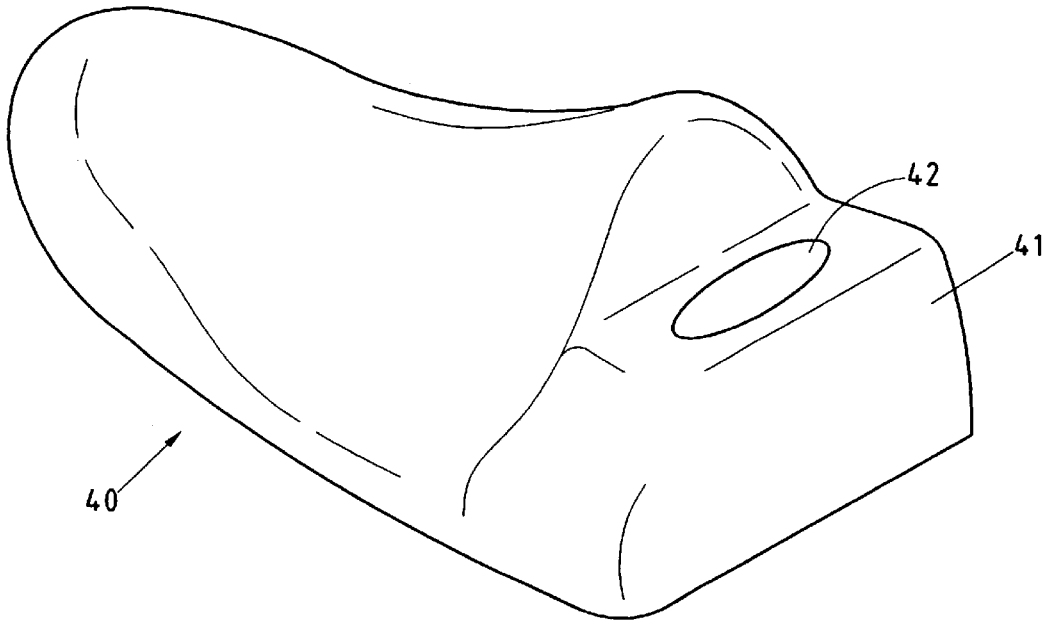
FIG. 5 shows another perspective view of the present invention.

As shown in FIG. 4, the shoe lining 40 can be easily placed into or taken out of the opening 51 of the leather shoe 50 by putting the finger in the through hole 42 of the seat 41. If the shoe lining 40 is larger than the toe's space 52 of the leather shoe 50, both sides of the seat 41 can be pressed slightly by fingers so that the width of shoe insert 40 shrinks so as to be able to be inserted into the inner part of the leather shoe 50. After positioning, the shoe insert 40 will return to its original shape so as to support the surface 53 of the leather shoe 50 straight and upright as usual.

It is a feature of the present invention wherein the shoe insert 40 can remove wetness while the leather shoe 50 is wet, and that the shoe insert 40 can be used again after air-drying or sun-drying.

It is another feature of the present invention wherein the shoe lining 40 can include in its composite material a fragrance, anti-bacterium, to rid mildew and to rid foul smell. As a result the inner portion of leather shoe 50 is sweet smelling and prevents bacteria from breeding.

It is still another feature of the present invention wherein the shoe lining 40 is molded from the liquid of recycled waste paper. Such structure has more strength than the structure of paper ball-shaped or plate-shaped, and further more efficiency in moisture absorption. The present invention can be recycled after use in that it will not affect the environment.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claim.

What is claimed is:

1. A shoe insert comprising:

a body formed of a recycled waste paper material of a unitary construction, said body having a hollow interior opening at a bottom of said body, said body having a toe portion and a seat formed at a rear end of said toe portion, said seat having a top planar surface extending from said rear end of said toe portion at a location below a top surface of said toe portion at said rear end, said top planar surface of said seat having a through hole formed therein of a diameter suitable for allowing a human finger to pass thereinto.

2. The shoe insert of claim 1, said through hole comprising a plurality of holes spaced from each other.

* * * * *